US005791075A

United States Patent [19]

Martell

[11] Patent Number: 5,791,075

[45] Date of Patent: Aug. 11, 1998

[54] COLLECTABLE DISPLAY DEVICE WITH EVACUATION MEANS

[76] Inventor: Janice J. Martell, 152-18 Union Turnpike - Apt. 2-S, Flushing, N.Y. 11367

[21] Appl. No.: 548,907

[22] Filed: Oct. 26, 1995

[51] Int. Cl.[6] ..... B65D 85/00

[52] U.S. Cl. ..... 40/1; 40/800; 206/315.9; 206/524.8; 206/776

[58] Field of Search ..... 40/1, 410, 661, 40/800; 206/315.9, 524.8, 776; 248/309.1, 314, 224.7

[56] References Cited

U.S. PATENT DOCUMENTS

| | | | |
|---|---|---|---|
| 2,777,233 | 1/1957 | Brendhorst | 40/1 |
| 3,233,727 | 2/1966 | Wilson | 206/315.9 X |
| 5,082,110 | 1/1992 | Hager | 206/315.9 X |
| 5,238,648 | 8/1993 | Kremen | 422/40 |
| 5,379,892 | 1/1995 | Recms et al. | 206/315.9 |

*Primary Examiner*—Casandra H. Davis
*Attorney, Agent, or Firm*—Kenneth P. Glynn, Esq.

[57] ABSTRACT

The present invention is directed to a device for visibly displaying collectable items. It includes: a main support base; a collectable item mount located in said base; a cover adapted to fit over the mount and adapted for connection to the base, the cover being at least partially transparent; a connecting mechanism for attaching the cover to the base; a seal located at an interface between the cover and the base when the cover is connected to the base; at least one evacuation port located on one of the cover and the base; and a one-way valve located in the evacuation port which is adapted to permit removal of air from the device and to prevent air from re-entering the device, when the cover is connected to the base. The device may be made to rest on a surface or may, surface mounted, either horizontally or vertically. In one preferred embodiment, the cover connects to the base via threading as the connecting mechanism.

8 Claims, 3 Drawing Sheets

COLLECTABLE DISPLAY DEVICE WITH EVACUATION MEANS

BACKGROUND OF THE INVENTION

1. Field of the Invention

The present invention is directed to devices which are used to display collectable items such as autographed baseballs, gems, coins, medals, and other collectable items. It is particularly directed to the purpose of preserving such items by including as a critical feature, the ability for a user to evacuate the display device itself. The devices of the present invention may be portable or may be permanently mounted. They may be smaller in size, e.g. to accommodate a diamond or a small coin, or may be larger in size, e.g., to accommodate collectables such as museum objects, rare bones or any other conceivable collectable item.

2. Information Disclosure Statement

Housings and display cases for collectable items have been in existence for hundreds years. Clearly, the museums of Rome, Greece and Egypt have used wood and glass display cases for hundreds and perhaps thousands of years. Today, there exist very sophisticated and expensive, permanent encasements which are used by most museums and these include complex electronic sensors, lasers and/or protective gases, as well as other means for preserving the collectable items contained therein.

Notwithstanding the above, it is believed that there does not exist any collectable item display device utilizing the portability, simplicity, and evacuation capabilities of the present invention devices which would render the present invention devices obvious or unpatentable.

SUMMARY OF THE INVENTION

The present invention is directed to a device for visibly displaying collectable items. It includes: a main support base; a collectable item mount located in said base; a cover adapted to fit over the mount and adapted for connection to the base, the cover being at least partially transparent; a connecting mechanism for attaching the cover to the base; a seal located at an interface between the cover and the base when the cover is connected to the base; at least one evacuation port located on one of the cover and the base; and a one-way valve located in the evacuation port which is adapted to permit removal of air from the device and to prevent air from re-entering the device, when the cover is connected to the base. The device may be made to rest on a surface or may, surface mounted, either horizontally or vertically. In one preferred embodiment, the cover connects to the base via threading as the connecting mechanism.

BRIEF DESCRIPTION OF THE DRAWINGS

The present invention should be more fully understood when the specification herein is taken in conjunction with the drawings appended hereto, wherein.

DETAILED DESCRIPTION OF THE PRESENT INVENTION

Figure 2:
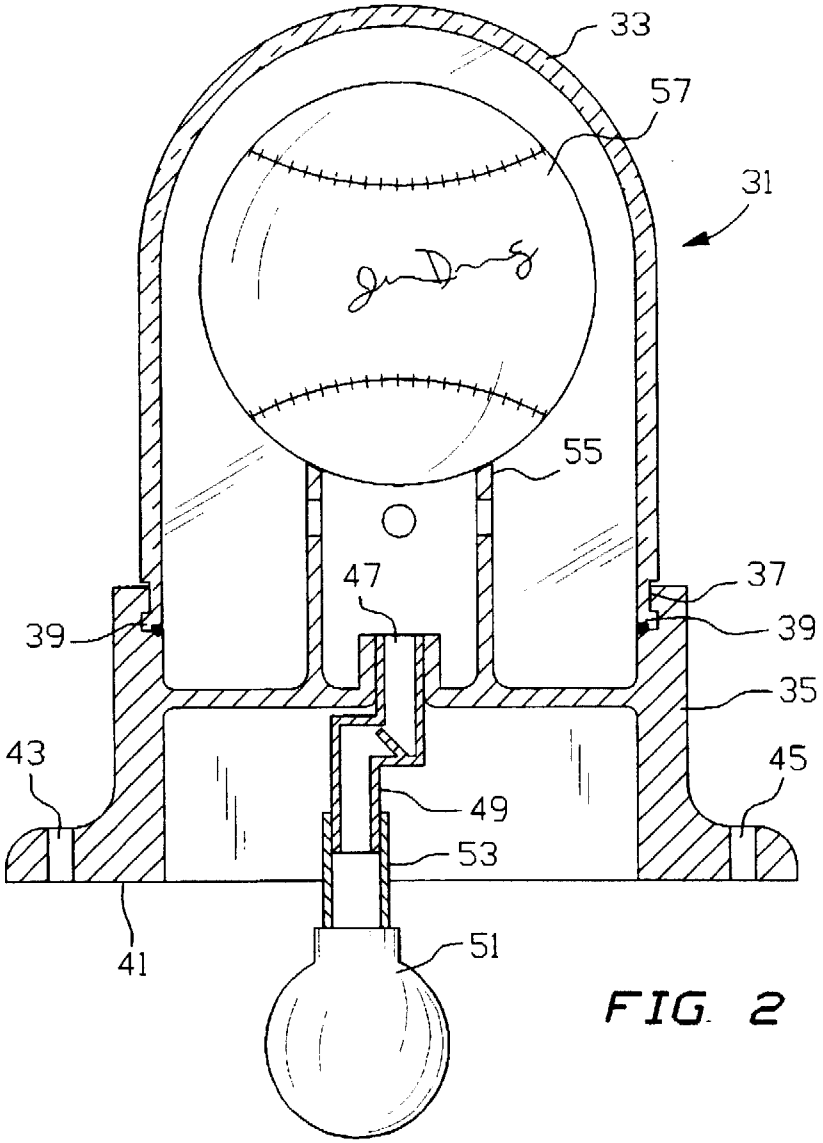
FIG. 2 shows an alternative embodiment present invention device with an autographed baseball and including evacuation means contained therein.

As mentioned above, the present invention involves a display device for collectable items. Most significantly, the present invention is directed to such display devices which are easy to use and portable and which include the ability for a user to place his or her own collectable item within the device, seal the device, and readily evacuate the device to remove air therefrom, so as to prevent oxidation and deterioration of the collectable item. Thus, the present invention device may be used to store any type of collectable item desired from very small items, such as gems and small coins, to very large items, such as meteors, fossils, rare artifacts and the like.

The present invention device includes a main support base and this may be made of metal, plastic, wood, stone, cast materials such as ceramic or even concrete or any other solid material. The support base may be flat or have legs or paws for resting on a horizontal surface, may be adapted to be attached to a vertical surface or may otherwise be formed within the scope of the invention. That is, the base could even have a semi-circular shape and still act as a base in a present invention embodiment. It could even take on other shapes so that it would be adapted to nest into some type of irregular nesting member, e.g. a tripod support.

The present invention device also includes a collectable item mount located on the base. This may be a portable mount or may be screwed, glued, welded, or otherwise affixed to the base, or it may be integrally formed when the base itself is formed. The critical aspect of the mount is that it holds a collectable item.

The present invention device also includes a cover. This cover may be glass or plastic or a combination of any of the materials made out of the base with some sort of a glass or plastic window included therein. Thus, the cover of the present invention device is at least partially transparent, although it may be fully transparent. While the drawings discussed below show domed embodiments of the cover, this cover could be box like, rectangular, hexangular or any other shape desired. One important feature in some preferred embodiments of the present invention is the use of an ultraviolet light inhibitor for the transparent portion of the cover. This inhibitor may be blended into the plastic resin or may be a separate film or coating.

The cover is adapted to attached to the base and that adaptation must be of a complimentary type. That is, in some fashion, the cover and the base must fit into one another such as where either the cover or the base has a protruding male insertable aspect and the other of the two has the receiving, female aspect. Typical connecting mechanisms can include snap downs such as are used in suitcases, threading, snap fits, or any other mechanism including screw downs. In the area located between the cover and the base must be a seal. This seal may be a separate element and may be formed of materials of construction other than those of the base and cover, such as a rubber ring seal, or, in those cases where the compatibility of the base and the cover are such that when they are force fitted together they inherently form a seal between them, then the receiving or connecting portions of the base cover themselves create and become the sealing means. In general, however, the base may be made of wood or plastic or other material and the dome will be made of glass or plastic and a rubber seal would be appropriate. Alternative types of seal means would be types of glues, flexible plastic materials and the like. The ability to seal a space between glass or glass and other material, such as wood and plastic is well known and the artisan could develop other mechanisms without exceeding the scope of the present invention.

Another feature of the present invention involves the evacuation aspect. Thus, either the cover or the base includes an evacuation port and a one way valve. The valve may be a flat valve, a seat valve, a bulb valve or any other type of valve. In fact, any valve available which operates to allow evacuation and prevents re-entry of air could be used. The valve may be fitted into the evacuation port and would typically have some mechanism for attachment to the evacuation means. This can include adaptations to a vacuum cleaner, or, more simply, adaptations to a bulb type evacuation mechanism such as described in conjunction with the drawings below.

Figure 1:
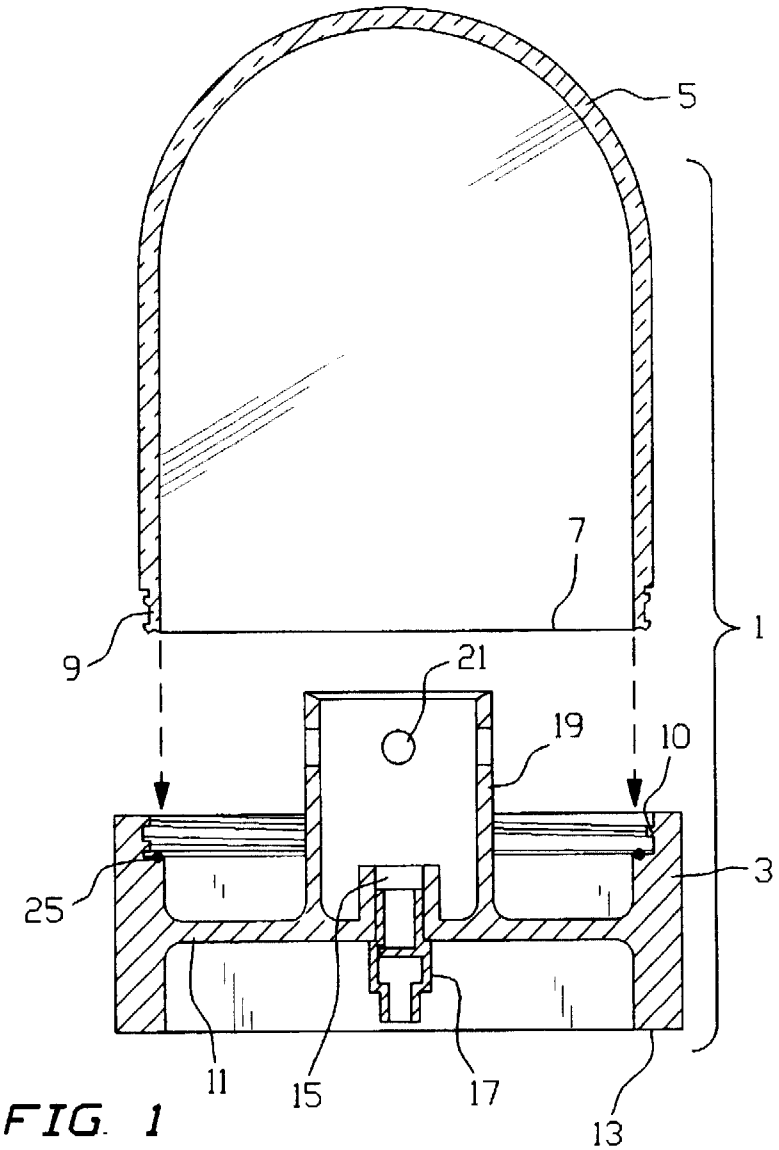
FIG. 1 shows a front cut view of a present invention embodiment using a dome cover.

Referring now to FIG. 1, there is shown a front cut view of a present invention device 1, which includes a base 3, and a cover 5. Base 3 and cover 5 include attachment means, i.e. threads, such as threads 9 and 10. At the base of threads 9 and 10 is a seal means to permit depressurization (evacuation) of the device when the base 3 and cover 5 are connected. Here, the seal means is a circular rubber gasket 25, which is comprised when cover 5, at its bottom 7, is fully threaded downwardly onto base 3 at threads 10.

Base 3 also includes mount 19 and this mount 19 includes evacuation holes such as hole 21. Base 3 has an evacuation port 15 which is raised above the lowest portion via circular leg 13. Port 15 has permanently inserted therein a one-way flap valve 17, which permits removal of air therefrom and prevents return of air therein, when cover 5 and base 3 are sealably connected and device 1 is evacuated through valve 17 and port 15.

A user would place a collectable on mount 19, screw transparent cover 5 onto wood base 3 tightly, and evacuate to remove air and decrease or inhibit corrosion, oxidation or tarnishing of the collectable.

FIG. 2 shows a front cut view of alternative embodiment present invention device 31, with cover 33 and base 35. Snap fit components (such as component 37) are included, along with a seal 39. Base 35 has a spread, hollow bottom 41, with anchor screw holes 43 and 45. Mount 55 surrounds evacuation port 47 and holds an autographed baseball 57. Evacuation port 47 has a one way valve 49 and has temporarily attached thereto a bulb 51 with attachment stem 53. The bulb 51 is simply squeezed and released repeatedly to achieve useful, partial evacuation. Other evacuation means could be used, e.g. a hose and pump, a vacuum cleaner adapter, or any other known evacuation means.

Figure 3:
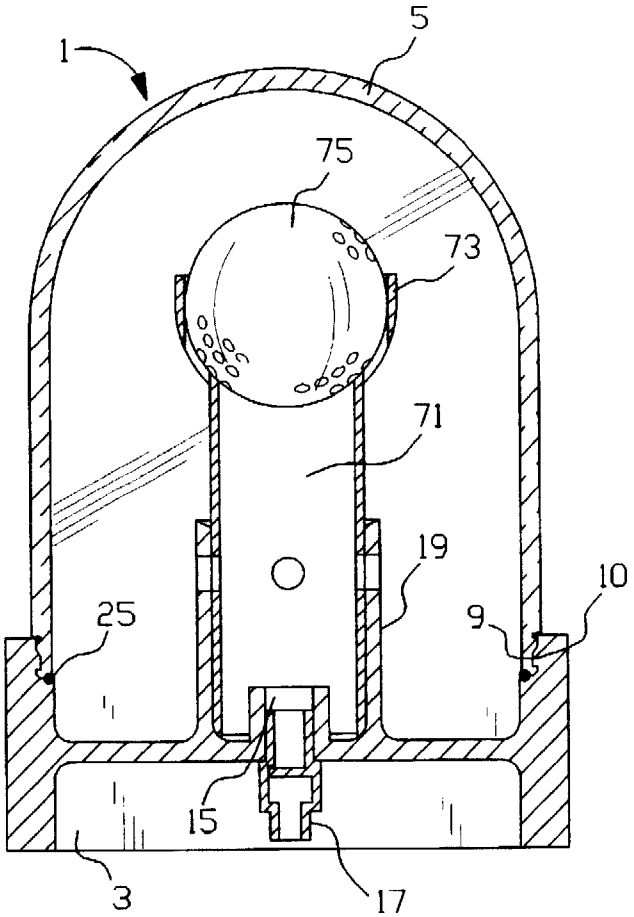
FIG. 3 shows a cut front view of the device shown in FIG. 1 but in it's assembled form, and with an auxiliary mount unit and with a hole in one golf ball contained therein.

FIG. 3 shows a cut view of device 1 of FIG. 1, but in its closed, sealed state, and with an auxiliary mount and collectable contained therein. Thus, all parts identical to those shown in FIG. 1 are identically numbered and need not be repeated. Mount 19 has been designed as a sleeve to receive a plurality of upper members, such as upper member 71, which is specifically designed to slide into (lower member) mount 19 and to hold a golf ball at semi-spherical top 73, such as golf ball 75.

Figure 4:
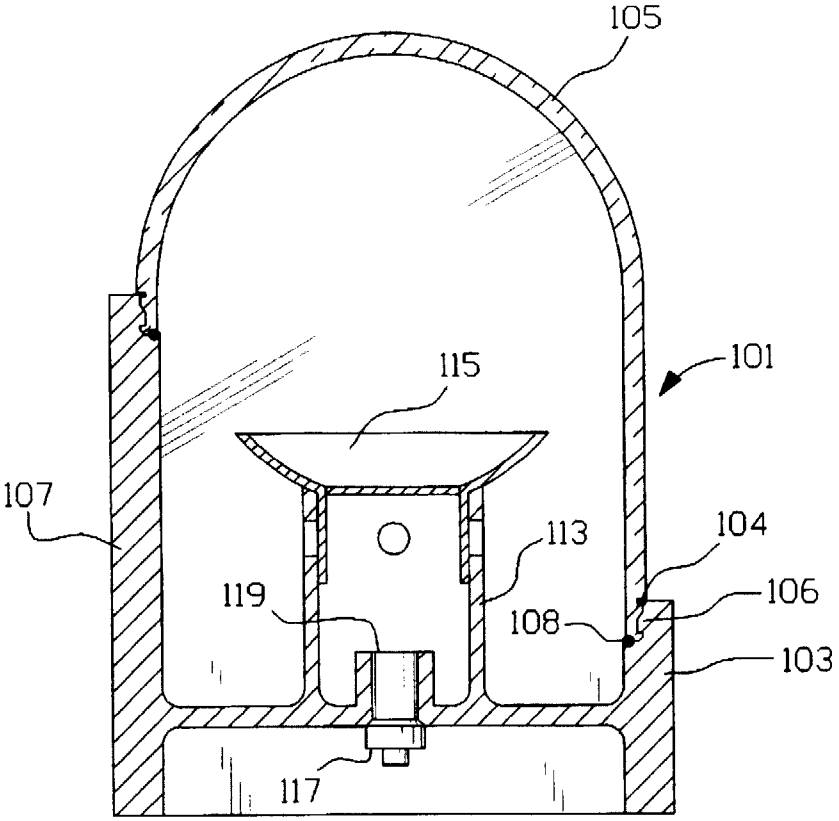
FIG. 4 shows a side cut view of a present invention device which is adapted to be utilized on a horizontal surface for display or to be permanently attached to a vertical surface such a wall, and, FIG. 5 shows a front view thereof with a collectable item on display.

FIG. 4 shows another alternative embodiment present invention device 101, in a side, cut view, having a base 103, snap fit components 104 and 106, cover 105, seal 108 and mount 113. Base 103 has a back 107 adapted for vertical mounting. One-way valve 117 is located in evacuation port 119 and is operated as described above. There is also an upper member 115 which slides into vertical, hollow mount 113 and this is interchangeable with other slide-in upper member mounts (not shown, but e.g. one alternative is shown as mount 71 in FIG. 3).

Figure 5:
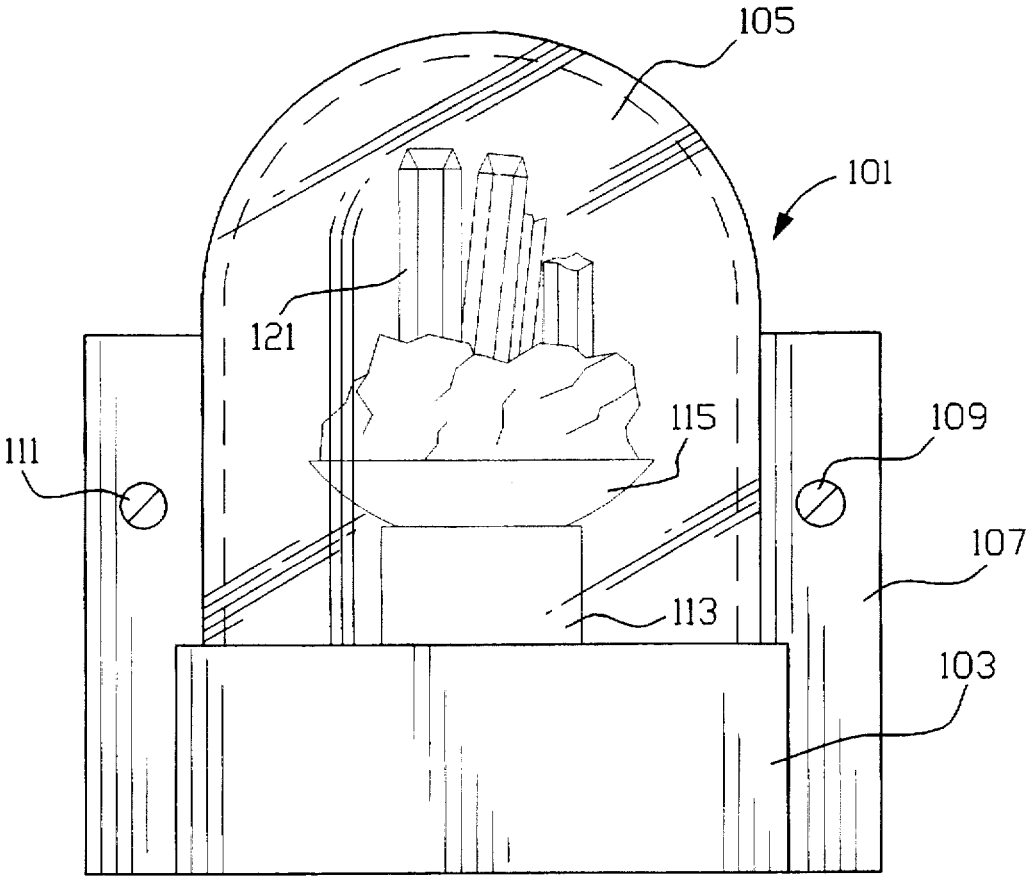

FIG. 5 shows a full front view of device 101 shown in FIG. 4, with identical parts identically numbered. Screws 109 and 111 are used to mount device 101 vertically, e.g. on a wall. Upper member 115 may be used to mount a baseball or other object, a medal or large commemorative coin or even a rock and crystals such as item 121 shown.

Obviously, numerous modifications and variations of the present invention are possible in light of the above teachings. It is therefore understood that within the scope of the appended claims, the invention may be practiced otherwise than as specifically described herein.

What is claimed is:

1. A device for visibly displaying collectable items, which comprises:

(a) a main support base;

(b) a collectable item mount located in said base, said mount including a lower member connected to said base and a plurality of upper members, each having different mount configurations adapted to mount different collectable items, said upper members being removably connected to said lower member and being interchangeable;

(c) a cover adapted to fit over said mount and adapted for connection to said base, said cover being at least partially transparent;

(d) connecting means for attaching said cover to said base;

(e) seal means located at an interface between said cover and said base when said cover is connected to said base;

(f) at least one evacuation port located on said base; and, (g) a one-way valve located in at least one evacuation port adapted to permit removal of air from said device an to prevent air from re-entering said device, when said cover is connected to said base.

2. The device of claim 1, wherein said support base is flat and adapted to rest on a horizontal surface.

3. The device of claim 1, wherein said device further includes securing means connected to said base and adapted to secure said base to a flat surface.

4. The device of claim 1, wherein said base includes attachment means which is adapted to be attached to a vertical surface.

5. The device of claim 1, wherein said connecting means is threading on said cover and said base.

6. The device of claim 1, wherein said mount is permanently connected to said base.

7. The device of claim 1, wherein said mount is a vertical hollow tubular member adapted to mount a spherical collectable item.

8. The device of claim 1, wherein said one-way valve includes a valve stem adapted to receive an evacuation pump.

* * * * *